US009649009B2

(12) United States Patent
Grimminger et al.

(10) Patent No.: US 9,649,009 B2
(45) Date of Patent: May 16, 2017

(54) METHOD FOR CONTROLLING A DOMESTIC APPLIANCE, USING SMART METERING

(75) Inventors: Jochen Grimminger, Tapfheim (DE); Tanja Haberlander, München (DE); Claudia Häpp, München (DE)

(73) Assignee: BSH Hausgeraete GmbH, Munich (DE)

( * ) Notice: Subject to any disclaimer, the term of this patent is extended or adjusted under 35 U.S.C. 154(b) by 51 days.

(21) Appl. No.: 13/817,829

(22) PCT Filed: Aug. 19, 2011

(86) PCT No.: PCT/EP2011/064274

§ 371 (c)(1),
(2), (4) Date: Feb. 20, 2013

(87) PCT Pub. No.: WO2012/031870

PCT Pub. Date: Mar. 15, 2012

(65) Prior Publication Data

US 2013/0145565 A1 Jun. 13, 2013

(30) Foreign Application Priority Data

Sep. 6, 2010 (DE) ..... 10 2010 040 297

(51) Int. Cl.
*A47L 15/46* (2006.01)
*D06F 33/00* (2006.01)
(Continued)

(52) U.S. Cl.
CPC ..... *A47L 15/46* (2013.01); *A47L 15/0047* (2013.01); *A47L 15/4291* (2013.01);
(Continued)

(58) Field of Classification Search
CPC ..... D06F 33/00; D06F 33/02; D06F 39/005; D06F 9/006; A47L 15/0047; A47L 15/46;
(Continued)

(56) References Cited

U.S. PATENT DOCUMENTS 6,269,506 B1 * 8/2001 Hollatz ..... D06F 39/06 68/12.02
2002/0088502 A1 * 7/2002 Van Rompuy ..... A47L 15/006 141/1
(Continued)

FOREIGN PATENT DOCUMENTS

DE 10062111 C1 * 7/2002
DE 202007015326 U1 6/2008
(Continued)

OTHER PUBLICATIONS

DE 102007019350 English Translation.*
(Continued)

*Primary Examiner* — Michael Kornakov
*Assistant Examiner* — Katelyn Whatley
(74) *Attorney, Agent, or Firm* — Laurence A. Greenberg; Werner H. Stemer; Ralph E. Locher

(57) ABSTRACT

A method and device for controlling a domestic appliance connected to an electric grid so as to allow smart metering, wherein electric power consumed according to different consumption tariffs is measured and the domestic appliance receives information about the availability of a currently applicable consumption tariff or a switch-off condition for preventing peak loads in the grid. The domestic appliance is operated as follows: a) when an inexpensive consumption tariff is available, the appliance is put into operation as intended, and the history of the cleaning process is continuously recorded; b) when an inexpensive consumption tariff is not available or the switch-off condition is met, the
(Continued)

appliance is not put into operation or a previously started operation is interrupted; and c) when information about an inexpensive consumption tariff is available, the domestic appliance resumes operation, and a component of a detergent is added based on the recorded history.

13 Claims, 4 Drawing Sheets

(51) Int. Cl.

| | |
|---|---|
| ***A47L 15/00*** | (2006.01) |
| ***A47L 15/42*** | (2006.01) |
| ***D06F 33/02*** | (2006.01) |
| ***D06F 39/00*** | (2006.01) |

(52) U.S. Cl.
CPC ..... *D06F 33/00* (2013.01); *D06F 33/02* (2013.01); *D06F 39/006* (2013.01); *A47L 2401/34* (2013.01); *A47L 2501/07* (2013.01); *A47L 2501/26* (2013.01); *A47L 2501/28* (2013.01); *A47L 2501/30* (2013.01); *A47L 2501/32* (2013.01)

(58) Field of Classification Search
CPC ..... A47L 2501/28; A47L 2501/32; A47L 2501/30; A47L 2401/12; A47L 2501/07; A47L 15/4291; A47L 2401/34; A47L 2501/26; G05B 13/02; G06C 50/06; H02J 2003/146; Y02B 70/3225; Y04S 20/222; Y04S 20/224; Y04S 20/242
USPC ..... 8/137; 68/12.02; 134/18, 56 D
See application file for complete search history.

(56) References Cited

U.S. PATENT DOCUMENTS

| | | | | |
|---|---|---|---|---|
| 2010/0070434 | A1* | 3/2010 | Cooper et al. | 705/412 |
| 2010/0147340 | A1 | 6/2010 | Hasses et al. | |
| 2010/0175719 | A1* | 7/2010 | Finch et al. | 134/18 |
| 2011/0186098 | A1 | 8/2011 | Hasse et al. | |
| 2011/0277794 | A1* | 11/2011 | King | 134/18 |

FOREIGN PATENT DOCUMENTS

| | | | | |
|---|---|---|---|---|
| DE | 102007019350 | A1 * | 11/2008 | F24D 19/10 |
| DE | 102008062349 | A1 | 6/2010 | |
| WO | WO 2010003952 | A1 * | 1/2010 | D06F 33/02 |

OTHER PUBLICATIONS

International Search Report PCT/EP2011/064274 dated Feb. 13, 2012.

National Search Report DE 10 2010 040 297.4 mail date Jan. 19, 2011.

Search Report dated Jan. 19, 2011 issued in related German Application No. 10 2010 040 297.4 (4 pages).

* cited by examiner

METHOD FOR CONTROLLING A DOMESTIC APPLIANCE, USING SMART METERING

CROSS-REFERENCE TO RELATED APPLICATIONS

This application is a national stage filing under 35 U.S.C. §371 of PCT/EP11/64274, filed Aug. 19, 2011, which claims priority to German Patent Application DE 10 2010 040 297.4, filed Sep. 6, 2010.

BACKGROUND OF THE INVENTION

The invention relates to a method for controlling a domestic appliance, in particular a washing machine or dishwasher for cleaning items of clothing and crockery respectively, when it is connected to at least one electric mains grid, which is especially branched off a public mains grid, within an individual household, the at least one electric mains grid being an intelligent system, such as a system allowing smart metering, so that measured power consumption is detected according to different consumption tariffs and information on the availability of a currently applicable consumption tariff or a switch-off condition for preventing peak loads in the mains grid is made available to the domestic appliance to be operated.

The invention also relates to a device, with which the method described above can be performed.

As background to the invention it has been identified that with new mains grids, which in particular allow smart metering, the economical operation of a domestic appliance, for example a washing machine or dishwasher, means that changes have to be made to the operation of said appliance, for example slowing down, speeding up and interruptions, which can significantly affect the result of the cleaning process of said appliance, if such influencing factors are not taken into account in some manner. In particular the cleaning action, which is based on the use of detergents or their individual components in the cleaning process, might be affected, as the detergents or their individual components are only able to allow their cleaning action to develop optimally, if they can be matched to specific temperatures and reaction and action times. Individual components, such as enzymes, in the detergent only have a very short life for example and require quite specific temperatures to have an optimum action.

Strategies are set out in DE 10 2008 062 349 A1 for domestic appliances, such as washing machines, dryers or dishwashers, in private households, which are operated on mains grids with smart metering, for how the domestic appliances can be operated price-optimally at times when the costs of drawing power are low but the domestic appliances according to the disclosure of this publication are only considered in respect of ohmic consumers of high output. The interruptions and resumptions of the operation of the domestic appliances according to this publication, as required by the focus on favorable consumption tariffs, are however not examined in respect of the cleaning result.

Intelligent power measurement or smart metering (digital power metering with extended functional scope) takes into account the fact that in future energy supply companies feeding into the public or their own mains grid, will be required to offer load-variable or time-based tariffs to their energy customers by way of their mains grids and to disseminate corresponding information in an appropriate manner. The power meters used up to now, for example Ferraris meters, will then no longer be used. However it should generally be considered that mains grids with integrated intelligence are also suitable for further aspects, such as a data exchange between energy customers and external service providers. It is also possible to optimize grid management by analyzing available data, especially from energy customers.

The use of such newly embodied mains grids, branched grids from which are present in a household, on which the generic domestic appliances are operated, means that the operation of the domestic appliances can be optimized in respect of available power tariffs. Washing and rinsing can therefore take place at low-tariff times. However it is also necessary to assume that there will be some very quick switches from high tariffs to low tariffs. However the domestic appliance should be operated mainly at low-tariff times, As well as the new energy supply company grids, it is also necessary in a household to take account of domestic grids, which can be connected temporarily to the generic domestic appliances in addition to the public grids of the energy supply companies. The question of taking into account a lower tariff in each instance can also be important here.

The prior art also includes domestic appliances, such as washing machines, in which for each cleaning program the detergent is dosed by the operator introducing a quantity of detergent into the widely known detergent drawer at least not exclusively but with automatically controlled dosing of the detergent or components of the detergent taking place in addition or instead. The publication DE 10 2007 028 173 A1 provides for a storage facility for liquid or gel-type detergent components, to which a controllable dosing facility for the stored detergent components is connected. In the publication DE 100 62 111 C1 the absorption behavior of the laundry introduced into the laundry drum is determined for the automatic subsequent dosing of a liquid detergent present in a storage container external to the washing machine. In the publication DE 10 2008 042 655 A1 storage containers for liquid detergents or detergent components are provided within the actual housing of the domestic appliance, for example a washing machine, with electrically driven feed or immersion pumps projecting therein. A control unit, the principle of which is explained, serves to activate the feed pumps based on information supplied about soiling, load, type of laundry and the like, thereby dosing the detergent components optimally.

BRIEF SUMMARY OF THE INVENTION

The object of the invention is therefore to specify a method for controlling a domestic appliance, in particular a washing machine or dishwasher, which produces an optimum treatment result even when taking account of inexpensive consumption tariffs.

An associated device together with a controller is also specified, which is suitable for performing the method.

This object is achieved with a method as specified in the introduction in that the domestic appliance is operated according to the following method steps:

a) when an inexpensive consumption tariff is available, the appliance is put into operation as intended, the history of the cleaning process being continuously recorded, b) when no inexpensive consumption tariff is available or a switch-off condition for preventing peak loads in the mains grid is met, the appliance is not put into operation as intended or a previously started operation is interrupted, and c) when information about an inexpensive consumption tariff is available, operation of the domestic appliance is resumed, the dosing of at least one component of a detergent being carried out as a function of the recorded history of the cleaning process.

It is possible with the inventive method, with the tariff or price signals made available with the energy supply by the relevant grid with intelligent power measurement or smart metering, to operate the domestic appliance in a cost-effective manner without any loss of cleaning power occurring due to inadequate effectiveness of the supplied detergent or detergent components. Because the cleaning process is recorded continuously in respect of its essential data, in other words its history, and said data is stored, in a similar manner to a black box, the required quantity of detergent or a detergent component can be dosed very precisely when a favorable consumption tariff is available again. This means that not only is the treatment sequence influenced in the very short term but a future sequence is too.

Although the invention relates to the new grids, which the energy supply companies have to offer due to statutory requirements with load-variable or time-dependent tariffs in the short term, it should also be possible to apply it to internal grids or isolated grids, particularly as said isolated grids are also operated taking into account cost aspects and the prevention of peak loads and therefore signals relating to energy costs and the prevention of overloading are available to the domestic appliance. It is then better not to operate the domestic appliance on a domestic grid available as a result of branching from the public mains grid any more but to use a domestic grid which has for example a photovoltaic basis or a supply from an electric generator, the drive motor of which supplies sufficient waste heat to heat the house. In this context mention should also be made of the production of electric energy using wind power, which is possible for a number of households or an individual household. It should also be noted that isolated grids can also extend over a number of households, for example a housing estate. It should also be taken into account that decentralized power plants with a photovoltaic or wind power basis can be joined to the public mains grid, so that virtual power plants can be assumed.

So that the domestic appliance does not resume its operation immediately during a very brief phase with an inexpensive consumption tariff, the grid is monitored continuously. It can then be forecast with a very high degree of probability that the recorded information about a favorable consumption tariff will be available for a longer period than the process time of the domestic appliance.

If the electric power consumed by the domestic appliance, in particular that used for heating the wash or rinse liquor, is measured continuously and recorded for the completed process sequence or history, very reliable information can be obtained to allow the respectively completed sequence of the cleaning process to be assessed. The heat input into the wash liquor still represents a major component which, together with the chemistry of the detergent and/or the movement introduced in a relative manner by the mechanical system of the domestic appliance (in the case of washing machines the items of laundry are lifted and dropped again by the agitators of the reversing drum; in the case of dishwashers the spray arm rotates with the jet of liquor or water exiting therefrom) triggers the cleaning action.

The continuous measurement of the temperature of the wash or rinse liquor provides informative values and data relating to the cleaning capability of the detergent and rinse agent. A temperature drop also says a lot about the cleaning process taking place and the heat output required when operation resumes.

It is also possible to detect and register foaming. The publication DE 10 2008 028 030 A1 shows how this can be done by means of an electric field. However other measuring methods are also possible. The surface tension of bubbles produced in the wash liquor can also be measured, thereby allowing conclusions to be drawn about detergent dosing in the wash liquor, which should then be registered. Detection of foaming and detergent dosing can also take place in combination with the detection of a temperature change, allowing even more precise conclusions to be drawn about the cleaning action due to detergents that have been introduced.

If the domestic appliance is switched on by the user at a time when no inexpensive consumption tariff is available, the domestic appliance will not start to operate as intended. So that the user does not have to make repeated attempts to switch it on, the switching on operation is stored in the domestic appliance as a slumber state, so that when the anticipated low consumption tariff is available, the domestic appliance can immediately start to operate as intended.

If it can be assumed based on a forecast that no inexpensive consumption tariff will be available for quite a long time and there is a second mains grid available in the household in question, for example from a solar unit, a generator with heat-power coupling or another decentralized power plant, such as a microgrid, it is also within the scope of the present invention for the domestic appliance then to be operated on this grid and for temporary disconnections from said grid (switch-off conditions to prevent overloading) also to produce a good cleaning result due to the application of the inventive method.

As it can also be economically expedient for the user of the domestic appliance not just to utilize one inexpensive consumption tariff but also a number, which do not exceed a certain price level, it should also be possible to use a plurality of such consumption tariffs. The information about said tariffs can be routed from an interface of the correspondingly configured smart meter in a wired or wireless manner to the corresponding domestic appliance. Other information-conveying interfaces, for example internet routers or other gateways, can also be used. A manual input by way of a keyboard can also take place for quite simple instances.

To achieve the inventive object, a device for controlling a domestic appliance is also provided with the features described in the introduction and for the inventive method, the domestic appliance also having:

- a computer-based controller with appropriate input signals and processed output signals for actuators,
- at least one input signal, which contains information about the availability of a low consumption tariff,
- at least one input signal, which is suitable for evaluating the history of the cleaning process,
- an output signal for controlling at least one dosing control element associated with at least one stored component of a detergent, and the controller operates by implementing a program, so that every time the cleaning process is resumed when a low consumption tariff is available, the history of the cleaning process is checked and the dosing of at least one component of the relevant detergent is made a function of the result of the evaluation of the history of the cleaning process.

The specified device is suitable for allowing the method according to the invention to be performed. The advantages specified in relation to the method are therefore also achieved. In so far as only the features associated with the invention have been specified in relation to the device, it should of course also be the case that the other sequences also take place in a program-controlled manner using the computer of the controller, to which end reference is made for example to the publication DE 199 08 363 B4.

BRIEF DESCRIPTION OF THE DRAWINGS

The subject matter of the claims that are dependent on the independent claim relating to the device also serves to develop the device.

The invention is described schematically in more detail in the figures which follow with reference to exemplary embodiments. Identical reference characters denote identical or comparable parts. In the figures.

DETAILED DESCRIPTION OF EXEMPLARY EMBODIMENTS OF THE PRESENT INVENTION

For a better understanding of the sequences currently provided compared with conventional sequences without the requirement of repeated resumption of operation, the conventional sequence of a domestic appliance, for example a washing machine, is first explained briefly.

Figure 1:
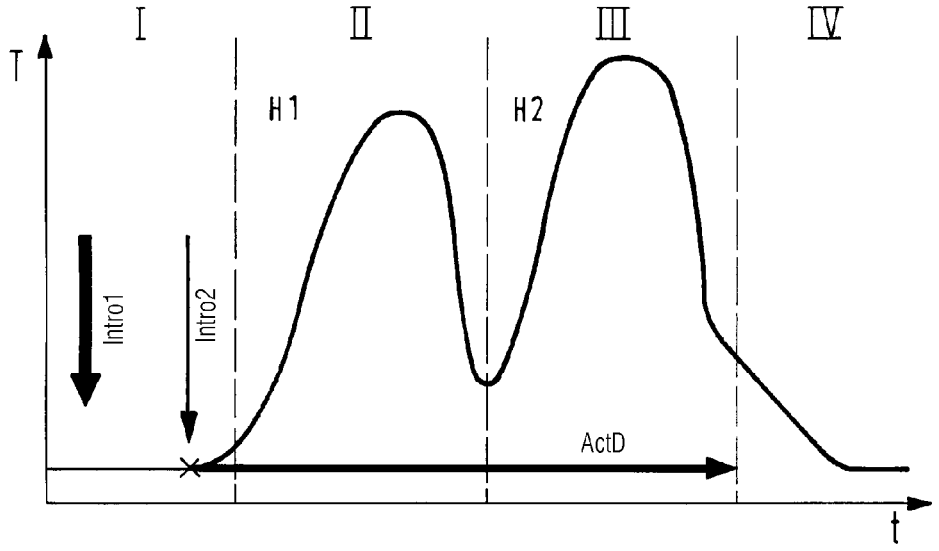
FIG. 1 shows a schematic diagram of a work process during the operation of a domestic appliance, for example a washing machine, on a conventional mains grid.

With reference to the diagram in FIG. 1 the conventional wash process takes place in such a manner that initially (see the entire time segment I) water is introduced into the treatment chamber, for example a drum within a drum housing—see the symbolic representation with a wide arrow marked Intro1. Toward the end of the introduction operation the detergent or detergent components is/are added to the water volume already present in the drum housing, for example by being washed out of the detergent drawer of the washing machine—see the symbolic representation with the narrow arrow Intro2. The wash liquor forms, absorbing the introduced detergent components in dissolved form. The actual wash cycle can start. During this, in addition to the cleaning action of the detergent components, the movement of the laundry items due to the, in some instances reversing, rotation of the drum plays an important role, as the laundry items introduced into the drum are continuously lifted up and then dropped back into the wash liquor. The cleaning action by the detergent components is however enhanced by providing a first and second heating phase—see time segments II and III. However further heating phases are also possible. If the operation of the washing machine is interrupted, the action of the detergent components extends into the dropping temperature region of the second heating phase, see the symbolic representation with the arrow shown with a wide line ActD as an abbreviation for the action of the detergent or its components. The dropping temperature region of the second heating phase is due on the one hand to the switching off of the heater (heating rods in the region of the liquor sump) of the washing machine and on the other hand to the already ongoing dilution of the liquor by cold fresh water being introduced. This can be followed by the spin cycle—see time segment IV. Time t is also shown along the abscissa and temperature T along the ordinate in FIG. 1. The actual profile shown, namely the temperature of the wash liquor plus the introduced laundry items, is however not shown to scale but just as an indication. The same applies to the following FIGS. 2 and 3.

Figure 2:
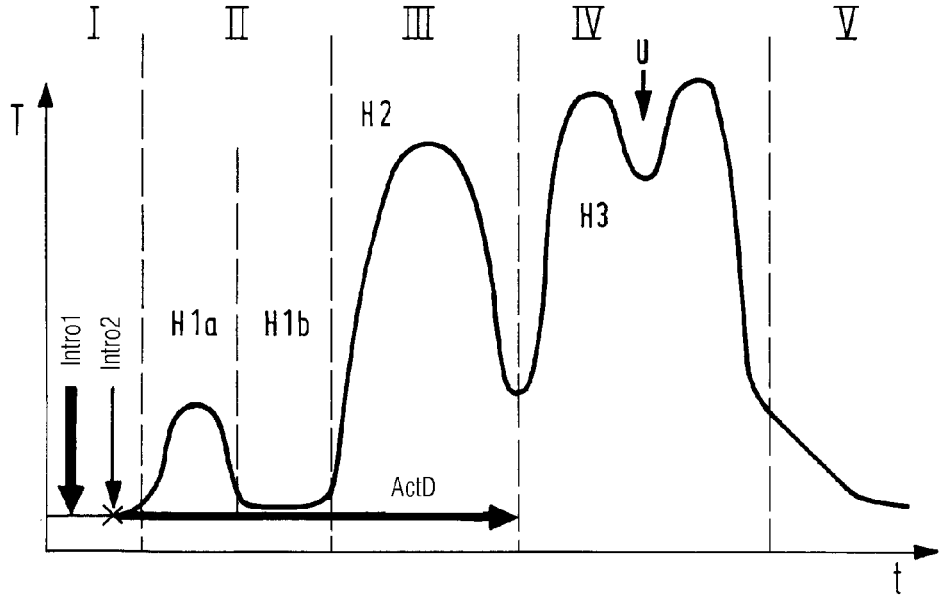
FIG. 2 shows a schematic diagram of a work process during the operation of the domestic appliance, for example a washing machine, during operation on a mains grid with smart metering without measures to adapt the domestic appliance.

If the domestic appliance, for example a washing machine, is not adapted to the behavior of the new mains grid with smart metering, a behavior as illustrated in FIG. 2 would result. In the first time segment I water is introduced—see the wide arrow Intro1—and the detergent or chemicals—see the narrow arrow Intro2. Then at the start of the second time segment II a first heating phase H1 can start, as an inexpensive power tariff is initially available, see H1*a*. However in the middle of the time segment II it is identified that there is no longer an inexpensive power tariff available or another switch-off condition, for example grid overload, is identified. The temperature of the wash liquor drops again, see H1*b* and remains at a low level until a second heating phase H2 operates in a time segment III. As the temperature drops in this second heating phase, the action of the detergent or its components in their dissolved form in the wash liquor also decreases, as the enzymes in particular stop acting due to their short life. This is shown with the arrow ActD shown with a wide line. A third heating phase H3, which is activated by the domestic appliance, for example the washing machine, from the point of view of the overall energy input assigned to the program, once an inexpensive consumption tariff is available again within time segment IV, is not as effective as anticipated in respect of its cleaning action, as the enzymes, as shown, were active in time segment II and III and are now no longer active. It should be noted, simply for an understanding of the situation, that there are two temperature maxima in time segment IV, as a brief switch to the higher consumption tariff means that there was a switching off and switching back on again. The short arrow U shows the point where the drop in the temperature of the wash liquor is most marked. The decreasing heating phase H3 in time segment IV is followed in time segment V by the spin cycle. The wash result for the completed wash of the laundry items is naturally not as good as for the conventional wash process described above with reference to FIG. 1, as the detergent introduced cannot act to its full capacity or over all the heating phases H1 to H3.

Figure 3:
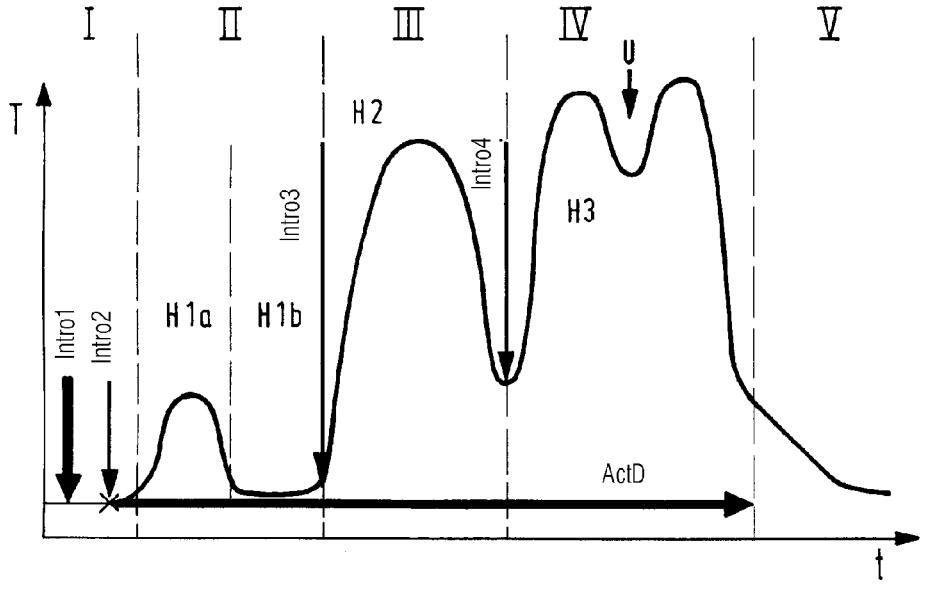
FIG. 3 shows a schematic diagram of a work process during the operation of the domestic appliance, for example a washing machine, on a mains grid with smart metering with measures for adaptation according to the invention.

However if the domestic appliance, for example a washing machine, is adapted to the behavior of the new mains grid with smart metering, the behavior illustrated in FIG. 3 results. The tariff switch and the cleaning program selected at the domestic appliance are the same as in the sequence according to FIG. 2. The time segments I to V are therefore also the same as in FIG. 2. The decisive difference is however that at the end of both time segments II and III there is an additional dosing and introduction of detergents or detergent components, see the symbolic representation with the arrows Intro3 and Intro4. It can be assumed that when detergent is first introduced toward the end of time segment I, the quantity can be reduced compared with the procedure for the sequences according to FIGS. 1 and 2, so that overall no greater detergent or detergent component outlay is required for the overall wash process. As a result it can be assumed that the detergent will be acting constantly up to the region of time segment IV, in which the heating phase IV decreases and the spin cycle then follows, as the very short life of the enzymes in the detergent is taken into account with the matched selective dosing. This result is shown symbolically in FIG. 3 by the arrow ActD shown with a wide line.

Figure 4:
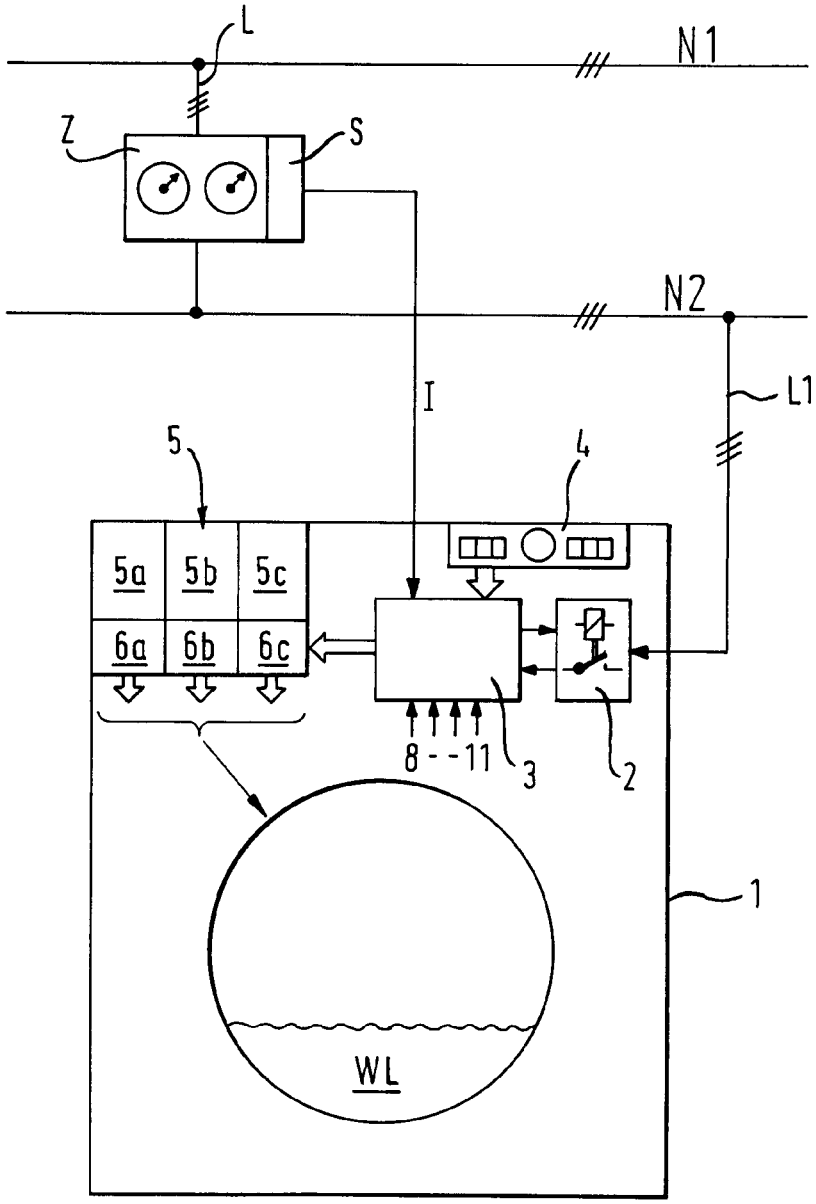
FIG. 4 shows a schematic view of the domestic appliance, for example a washing machine, supplemented by a block diagram and with a possible power connector.

FIG. 4 shows the domestic appliance, for example a washing machine 1, initially in relation to the power connector. A public mains grid N1 is provided to supply a number of households with electric energy. A branch line L passes from this grid to the mains grid N2 of the relevant household, in which the domestic appliance 1 is set up. Connected in the passage of power in the branch line L is a smart meter Z, which meters the consumed energy of the relevant household. Metering takes place according to at least two different tariffs however. An interface S is present at this meter Z, forwarding signals containing information I to the domestic appliances of said household in a wired or wireless manner, so that the respective domestic appliance receives information about the currently applicable tariff or whether at least the respective domestic appliance should be taken out of operation to prevent a peak load in the public mains grid. Up to the point of the meter Z such information in the mains grid N1 is generally transmitted in the grid itself by way of remote control signals, for example Powerline, Z-Wave or Zig-Bee but use can also be made of such systems for the wireless transmission of the information I from the output of the meter Z. A line L1 passes from the grid N2 of the household to the domestic appliance 1. An appliance input part 2 serves to distribute the electric energy within the domestic appliance. A power switch (no reference character) is also visible, which is able to switch off all the major consumers of the domestic appliance as required—when the consumption tariff is expensive or a switch-off condition is met. A controller 3 of the domestic appliance is constantly supplied with a certain level of electric energy in order to be able to respond continuously to the information I present at the input of said controller. A battery buffer or some other buffer, for example supercapacitors, can be provided. The input signals supplied to the controller 3, which has a computer-based structure, are all the signals, optionally combined in the manner of a bus, from a program part 4 of the domestic appliance, which is also available to an operator for setting the desired wash program. The controller 3 also receives a series of sensor inputs 8 to 11, which relate to the wash process and are explained in more detail below.

The washing machine 1 is also fitted with a module 5 for detergent or detergent components, which are referred to in the following as 5*a*, 5*b* and 5*c*. Each of the components can be fed or dosed into the wash liquor in a selectively controlled manner. To this end the module for each component is connected to an immersion pump driven by an electric motor or an electrically activated valve or solenoid valve, which is activated from a power output of the controller 3. The elements cited by way of example, such as immersion pump or solenoid valve, are referred to in the following as dosing control elements. Associated with the stored detergent components 5*a*, 5*b* and 5*c* therefore are dosing control elements 6*a*, 6*b* and 6*c*. When one of the dosing control elements is activated, the relevant detergent component is released according to the activation period. The relevant quantity of a detergent component, optionally with a certain quantity of fresh water, is then introduced into the liquor housing enclosing the laundry drum. This is shown schematically in FIG. 4. As known structures, see DE 10 2008 042 655 A1, are used here, there will be no further description with reference to reference characters. The same applies to the basic sequence of a cleaning program, for example a wash program. Reference is made for example to DE 101 36 518 A1 for this purpose. There is also no need for a description of the drive for the drum of the washing machine and its actuation or for a drain pump facility for the wash liquor during wash and spin cycles, as these are well known.

With reference to FIG. 3—also with an understanding of the descriptions given in relation to FIG. 2—according to the present teaching at the end of time segment I the quantity of detergent component 5*a* is determined by way of the dosing control element 6*a* and released for introduction with the fresh water, shown with the arrow Intro2. At the end of time segment II—see arrow Intro3—the dosing control element 6*b* is actuated when a favorable consumption tariff is once again available and a quantity of a second detergent component 5*b* is released for introduction into the tub.

As set out above, the active period of the detergent can thus be extended despite a previous switching off of the domestic appliance. This is assisted by the fact that, between the heating phases H2 and H3, in other words during the transition from time segment III to time segment IV—see arrow Intro4—a further dosing of a detergent component, for example 5*c*, takes place by means of activation by way of the dosing control element 6*c*.

The activation sequence for the dosing control elements does not have to be the same every time. A different activation sequence for the dosing control elements can also be used or there can be a combination of dosing control element activations. More or fewer than three detergent components and associated dosing control elements can also be used. At the start of a wash program—see time segment I—it can generally be assumed that instead of the arrow Intro2 a quantity of detergent component or combination of detergent components 5*a* to 5*c* determined by the selected wash program—generally in conjunction with the load size and type of laundry—will be predefined. Instead of the arrow Intro3 and Intro4 however the cleaning or washing process continues, so this has to be taken into account. According to the invention provision is made for the history of the cleaning process to be taken into account for the dosing of at least one component of the detergent, for example the detergent component 5*a* to 5*c*.

Figure 5:
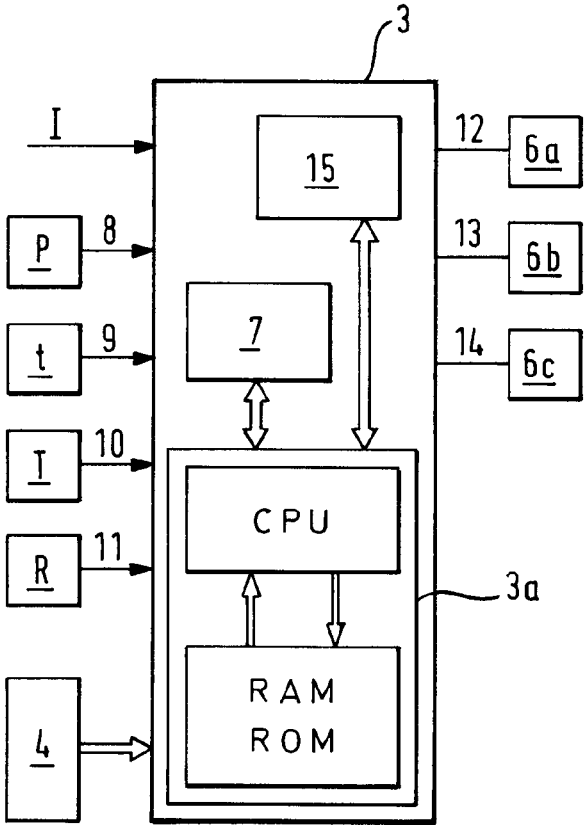
FIG. 5 shows a schematic diagram of a further block diagram of the controller of the domestic appliance, for example a washing machine.

FIG. 5 shows certain aspects of the computer-based controller 3 with its computer 3*a* in further detail as relevant. A storage region is provided within the controller 3, which is to serve essentially for the embodiment of the history of the cleaning process. This storage region is therefore referred to as the history store 7. The controller with its computer 3*a* also has a standard storage region, for example RAM or ROM, the latter serving to store the—implemented—program. The central computation unit is shown as CPU. However it should be noted in the present instance that a microcomputer is preferably used as the computer 3*a*, so that these components can then be combined in one structural element. The dosing control elements 6*a* to 6*c* in particular are connected to the output of the controller 3, directly of the computer 3*a*, for example using power amplifiers. At least one signal containing information I about the availability of a low consumption tariff is fed to the input side of the controller 3. Measuring sensors or measuring facilities are also connected, helping to map the progress of the cleaning process and allowing storage in the history store 7 as the implemented program is executed. Such input signals are in particular those which contain information about the electric power consumed P, see signal 8, for example for heating the liquor, the elapsed cleaning time t, see signal 9, the temperature T of the wash liquor WL, see signal 10, and the current cleaning action R of the wash liquor WL. This list is not exhaustive however. Other signals can also be supplied or cited signals can be omitted. It is also possible to replace certain signals, which are difficult to measure, with easily measured replacement signals and to use a computation model to determine the actual signal required. It is however important that the implemented program serves, every time the cleaning process is resumed when a low consumption tariff is available, to check the history—by reading the history store 7—of the cleaning process and to make the dosing of at least one component of the relevant detergent a function of the result of the evaluation of the history of the cleaning process. An output signal 12 also serves to activate the dosing control element 6*a*, an output signal 13 serves to activate the dosing control element 6*b* and an output signal 14 serves to activate the dosing control element 6*c*.

It is also necessary for the success sought with the present invention that the actually available grid is monitored. To this end a monitor 15 can be implemented in the computer 3*a* of the controller 3—communicating with its computer 3*a*—so that information is received about the behavior of the available grid, for example the public mains grid. It can be derived from such monitoring whether information received about the availability of a low consumption tariff should be evaluated such that quite long availability of the signaled favorable consumption tariff can be assumed. It is thus possible to eliminate tariff switches that are too short when controlling the domestic appliance. However other strategies for preventing the domestic appliance possibly responding incorrectly to tariff switches that are too short are also possible. For example the dosing of detergent on the switch to the low tariff can be delayed or divided into a number of doses, which are then only introduced when the low tariff is available again. It is therefore possible to determine a future process sequence by means of the program implemented in the ROM by reading out the data stored in the history store 7.

The invention claimed is:

1. A method for controlling a domestic appliance constructed to perform a cleaning process and connected within an individual household to at least one electric mains grid implemented as an intelligent system capable of detecting measured power consumption according to different consumption tariffs and according to information about an availability of a currently applicable consumption tariff or according to a switch-off condition for preventing peak loads in the at least one electric mains grid, the method comprising the steps of:

a) when an inexpensive consumption tariff is available, starting an intended operation of the domestic appliance and continuously recording a history of the cleaning process, wherein the recording the history of the cleaning process includes detecting a temperature and a change in temperature of a wash liquor or rinse water, b) when an inexpensive consumption tariff is not available or the switch-off condition for preventing peak loads in the at least one electric mains grid is met, preventing start of the intended operation of the domestic appliance or interrupting a previously started operation, and c) when information about an inexpensive consumption tariff is available, resuming the intended operation of the domestic appliance, and adding at least one component of a detergent in a dose based on the recorded history of the cleaning process, wherein the domestic appliance is a washing machine for cleaning items of clothing or a dishwasher for cleaning crockery.

2. The method of claim 1, wherein the intelligent system allows smart metering.

3. The method of claim 1, wherein the at least one electric mains grid is branched off a public mains grid.

4. The method of claim 1, wherein the information about availability of an inexpensive consumption tariff in step c) comprises continuously monitoring the at least one electric mains grid to forecast the availability of the inexpensive consumption tariff over a future longer time period.

5. The method of claim 1, wherein a dosage of the at least one added component of a detergent in step c) is predetermined.

6. The method of claim 1, wherein the recorded history of the cleaning process comprises electric power consumed by the domestic appliance over an elapsed time during which the intended operation is performed.

7. The method of claim 6, wherein the consumed electric power is used to heat a wash liquor.

8. The method of claim 1, wherein recording the history of the cleaning process comprises detecting a degree of foaming as a function of a change.

9. The method of claim 1, wherein when the domestic appliance is first switched on, an intended operation is started only when an inexpensive consumption tariff is identified.

10. The method of claim 1, further comprising transmitting to the domestic appliance wire-based or wirelessly a plurality of inexpensive consumption tariffs to be taken into account.

11. The method of claim 1, wherein the recorded history is indicative of a progress of the cleaning process.

12. The method of claim 1, wherein the at least one component of the detergent is added to extend an active period of the detergent.

13. The method of claim 1, wherein the recorded history of the cleaning process is checked upon resuming the intended operation of the domestic appliance when the information about the inexpensive consumption tariff is available.

* * * * *